US011329373B1

(12) United States Patent
Alam et al.

(10) Patent No.: US 11,329,373 B1
(45) Date of Patent: May 10, 2022

(54) PLANAR ANTENNA FOR WIRELESS COMMUNICATION

(71) Applicant: King Abdulaziz University, Jeddah (SA)

(72) Inventors: Md Mottahir Alam, Jeddah (SA); Rezaul Azim, Chittagong (BD); Mohammad Tariqul Islam, Kajang (MY); Asif Irshad Khan, Jeddah (SA); Ibrahim M. Mehedi, Jeddah (SA)

(73) Assignee: King Abdulaziz University, Jeddah (SA)

( * ) Notice: Subject to any disclaimer, the term of this patent is extended or adjusted under 35 U.S.C. 154(b) by 0 days.

(21) Appl. No.: 17/508,438

(22) Filed: Oct. 22, 2021

(51) Int. Cl.

| | |
|---|---|
| ***H01Q 1/36*** | (2006.01) |
| ***H01Q 1/44*** | (2006.01) |
| ***H01Q 23/00*** | (2006.01) |
| ***H01Q 1/38*** | (2006.01) |

(52) U.S. Cl.
CPC ..... *H01Q 1/44* (2013.01); *H01Q 1/38* (2013.01); *H01Q 23/00* (2013.01)

(58) Field of Classification Search
CPC ..... H01Q 1/44; H01Q 1/38; H01Q 23/00; H01Q 1/243; H01Q 9/0407; H01Q 1/48; H01Q 21/28; H01Q 1/36; H01Q 13/10; H01Q 1/273; H01Q 1/24; H01Q 5/378; H01Q 1/22
See application file for complete search history.

(56) References Cited

U.S. PATENT DOCUMENTS

| | | | | |
|---|---|---|---|---|
| 2017/0229763 | A1* | 8/2017 | Barak | H01Q 1/38 |
| 2019/0372200 | A1* | 12/2019 | Sharawi | H01Q 1/38 |
| 2020/0227821 | A1* | 7/2020 | Wu | H01Q 21/22 |

FOREIGN PATENT DOCUMENTS

| | | | |
|---|---|---|---|
| CN | 108899650 | A | 11/2018 |
| WO | WO 2016/144155 | A1 | 9/2016 |

OTHER PUBLICATIONS

Dharmarajan, "A Human Face Shaped Microstrip Patch Antenna for Ultra Wideband Applications" (Year: 2020).*

(Continued)

*Primary Examiner* — David E Lotter
(74) *Attorney, Agent, or Firm* — Oblon, McClelland, Maier & Neustadt, L.L.P.

(57) ABSTRACT

A planar antenna includes a radiator and a ground plane, where the radiator is formed on the ground plane. The radiator includes a printed microstrip line. The radiator includes a human face-shaped radiator pattern printed on a side of the substrate. The human face-shaped radiator pattern has an elliptical head portion, two eye portions with printed eyeball portions, two ear portions, and a mouth portion. The printed microstrip line connects to the human face-shaped radiator pattern. The ground plane includes first, second, and third circular defect areas printed on back side of the substrate. The first and second circular defect areas have the same diameter, while the third circular defect area has a diameter smaller than the first and second circular defect areas. The third circular defect area is closer to an end surface of the ground plane than the first and second circular defect areas.

20 Claims, 4 Drawing Sheets

(56) References Cited

OTHER PUBLICATIONS

A Dharmarajan, et al., "A Human Face Shaped Ultra Wideband Microstrip Patch Antenna with Enhanced Bandwidth", IEEE International Multidisciplinary Information Technology and Engineering Conference (IMITEC), Nov. 21-22, 2019, 5 pages.
Cancan Hu, et al., "Dumbbell Shaped Defected Ground Structure High Gain Antenna for Dual Band Application", International Journal of Advances in Microwave Technology (IJAMT), vol. 3, No. 1, Feb. 2018, pp. 146-151.

* cited by examiner

PLANAR ANTENNA FOR WIRELESS COMMUNICATION

STATEMENT OF ACKNOWLEDGEMENT

The inventors extend their appreciation to the Deputyship for Research and Innovation, Ministry of Education in Saudi Arabia for funding this research work through the project number 2021-021 and King Abdulaziz University, DSR, Jeddah, Saudi Arabia.

BACKGROUND

Technical Field

The present disclosure is directed to antennas and more specifically to planar antennas having a suitable reference level across a wide range of highly utilized transmitting and receiving frequencies.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Cellular video usage continuously increases as a result of the growing number of mobile subscribers, smartphones, tablets, and IoT-related devices. Network speeds are upgraded to maintain quality of service despite the increasing traffic. The fifth generation (5G) of mobile networking technology has been implemented to fulfill the growing demand. Systems implementing 5G standards provide faster data rates, lower latency times, higher traffic volume, higher density of connections, and greater mobility when compared to earlier networks. While designed to operate across a wide frequency band, 5G networks are intended to concurrently support many connections.

The design of an operational antenna for 5G or subsequent systems is quite challenging and becomes a key component for implementation. Any suitable option necessitates satisfactory gain, efficiency, and stable radiation characteristics for a wide bandwidth, i.e., across not only the complete 5G sub-6 GHz band, but also the well-established narrow service bands for existing systems already in use (including Institute of Electrical and Electronics Engineers (IEEE) 802.11 standards such as WiFi or Wireless Local Access (WLAN), Worldwide Interoperability for Microwave Access (WiMAX), and/or fourth generation Long-Term Evolution (4G LTE)). Well-established wireless standards include a number of specific frequency ranges, including 3.6 GHz, 4.9 GHz, 5 GHz, and 5.9 GHz for WiFi-compliant systems, 3.3 GHz, 3.5 GHz, and 5.8 GHz for WiMAX-enabled devices, 3.6 GHz, 4.6 GHz, 5 GHz, and 5.9 GHz for WLAN, as well as 3500 MHz, 3600 MHz, 3700 MHz, 5200 MHz, and 5900 MHz for 4G LTE bands.

However, antenna design for a multi-band transmission device presents additional difficulties based on various related aspects of the used frequency ranges. For portable devices such as smartphones and smaller tablet computers, compatibility corresponds to the size of any included component. In other words, only components that can fit within those portable systems are feasible solutions. For instance, microstrip planar antennas have been suggested as one of the most suitable options, due to a number of their attributes, e.g., lightweight, low-profile, inexpensive, and easily integrable with portable communication devices.

Several specific antenna designs have been proposed for 5G-compliant multi-protocol communication. Though several antennas purportedly are designed to work for a wide operating band, these designs carry drawbacks like having a large volumetric size, using a three-dimensional, multifaceted structure, and/or exhibiting poor efficiency. For example, in An and He ("A simple planar antenna for sub-6 GHz applications in 5G mobile terminals," Applied Computational Electromagnetics Society Journal, vol. 35, pp. 10-15, 2020) an antenna is discussed for mobile terminal usage. The proposed antenna includes a guided strip having three ground strips, which allows their design to operate in the 0.7-0.96 GHz and 1.6-5.5 GHz bands. Using this design, however, requires a ground plane with a surface area of 135 mm×80 mm, which is quite large in relation to the devices in which they would be employed.

Arya et al. ("A dual-band antenna for LTE-R and 5G lower frequency operations," Progress in Electromagnetic Research Letters, vol. 88, pp. 113-119, 2020) describe an ellipse-shaped antenna for both LTE and 5G sub-6 GHz bands. The proposed antenna has dimensions of 180 mm by 60 mm, again creating a large design footprint. Arya's solution is operative over split bands of 0.66-0.79 GHz and 3.28-3.78 GHz.

Another suggested solution is a magneto-electric dipole antenna, proposed by Sun et al. ("A dual-polarized magneto-electric dipole antenna for application to N77/N78 band," IEEE Access, vol. 7, pp. 161708-161715, 2019). Sun's system is shorted to the ground and is suitable for sub-6 GHz 5G networking applications. The antenna in Sun includes four parallel fishtail-shaped patches and four perpendicular patches, having dimensions of 150 mm×150 mm×21 mm and a working frequency range of 3.05 GHz to 4.42 GHz. Notably absent in this operative frequency range is the 4.4-5.0 GHz band. Moreover, the 3D profile of Sun's antenna (i.e., 21 mm) limits its useful integration into small, hand-held devices such as current smartphones or even smaller devices.

Khalifa et al. ("Broadband printed-dipole antenna for 4G/5G smartphones," Journal of Physics: Conference Series, vol. 1447, pp. 6588-6596, 2020) disclose a monopole antenna for 4G and/or 5G purposes. Khalifa's antenna includes a single element, operable in two bands—1.24-2.64 GHz and 3.34-5.0 GHz. However, due to its 150 mm×80 mm size, this design cannot cover portions of needed frequency ranges (e.g., the N79 band). In an investigation by Leong et al. ("Surface wave enhanced broadband planar antenna for wireless applications," IEEE Microwave and Wireless Component Letters, vol. 11, no. 2, pp. 62-64, 2001), a broadband printed antenna is discussed. The antenna is constructed with a dipole element, a parasitic element, and a truncated ground plane. Leong's antenna covers a wide band of 3.4-5.5 GHz, but once again occupies a large footprint, with 120 mm×60 mm measurements.

Another relatively large design is disclosed by Sarade et al. ("Design of microstrip patch antenna for 5G application," in Proceedings of the 2nd International Conference on Advanced Technologies for Societal Applications 2018, 14-15 Dec. 2018, India, pp. 253-261). This planar antenna is made up of a simple rectangular patch suitable for 5G communication, which has an operating frequency centered at 2.425 GHz. A limitation of Sarade's solution is its dimensions of 114 mm×77 mm×1.6 mm. With a slightly smaller 80×50 mm design, Tang et al. ("Ultra-wideband patch antenna for sub-6 GHz 5G communications," in Proceedings of the International Workshop on Electromagnetics: Applications and Student Innovation Competition 2019, 18-20 Sep. 2019, China) discuss a UWB antenna. Tang's antenna is, however, only suitable for lower 5G communication frequencies (2.32-5.24 GHz band).

Gopal and Thangakalai ("Cross dipole antenna for 4G and sub-6 GHz 5G base station applications," Applied Computational Electromagnetic Society Journal, vol. 35, no. 1, pp. 16-22, 2020) propose another solution for 4G and 5G applications at sub-6 GHz, which consists of a dipole antenna design. Each component of this antenna has 76 mm×42 mm dimensions to encompass both dipole elements and a balun. The antenna architecture in Gopal and Thangakalai worked successfully between 1.341 and 3.834 GHz, but not in the whole 5G sub-6 GHz range.

Dharmarajan et al. ("A human face shaped ultra wideband microstrip patch antenna with enhanced bandwidth," in Proceedings of the International Multidisciplinary Information Technology and Engineering Conference 2019, 21-22 Nov. 2019, South Africa, hereinafter "Dharmarajan I") successfully demonstrate a planar UWB antenna having a frequency range operating along portions of the band from 3-14.7 GHz. However, the antenna in Dharmarajan I creates a notch band between 5 and 6.3 GHz. As a result, this design cannot cover the 5.8 GHz bands used by WiFi, WiMAX, and WLAN devices. In a second text by Dharmarajan et al. ("A human face-shaped microstrip patch antenna for ultra-wideband applications," In: Kalam A., Niazi K., Soni A., Siddiqui S., Mundra A. (eds) Intelligent Computing Techniques for Smart Energy Systems, Lecture Notes in Electrical Engineering, vol. 607, 2020. Springer, Singapore. Doi:10.1007/978-981-15-0214-9_92, hereinafter "Dharmarajan II"), a roughly human face-shaped antenna is disclosed for use in ultra-wideband (UWB) applications. On the smaller end of conventional designs, the antenna in Dharmarajan II has dimensions of 25.2 mm×38.2 mm. This solution can operate in the frequency range between 5.9 and 11.2 GHz, but it cannot cover standard 3.5 GHz WiFi and WiMAX bands.

A patch antenna is described in Jain et al. ("Elliptical shaped wide slot monopole patch antenna with crossed shaped parasitic element for WLAN, Wi-MAX, and UWB application," Microwave and Optical Technology Letters, vol. 62, no. 2, pp. 899-905, 2020), which has an elliptical shape and a crossed-shaped parasitic feature. Unlike the above designs, Jain's antenna has a smaller size, measuring 40 mm×40 mm×1.59 mm. However, the antenna of Jain achieved three operating bands of 2.28-2.62 GHz, 2.70-3.96 GHz, and 5.1-6.29 GHz. Notably, these operating frequencies mean that Jain fails to cover the upper bands of 5G sub-6 GHz and UWB applications.

A first investigation by Azim et al. ("A T-shaped printed planar antenna on epoxy-resin material for ISM/WiFi/Bluetooth/WiMAX/WLAN applications," Optoelectronics and Advanced Material-Rapid Communications, vol. 14, no. 11-12, pp. 509-514, 2020, hereinafter "Azim I") describes a microstrip planar antenna for WiFi, ISM band, Bluetooth, WiMAX, and WLAN applications. With an overall size of 79.8 mm×57.8 mm, the proposed design in Azim I achieves a bandwidth of 1.54 GHz (2.02 to 3.56 GHz). However, the antenna of Azim I fails to cover a number of WiFi frequencies (4.9 GHz, 5 GHz, and 5.9 GHz), as well as those in other protocols (e.g., WiMAX WLAN, LTE, and NR79 bands). A multi-slotted low-profile patch antenna designed for LTE and 5G sub-6 GHz transmission systems is explored in a second study by Azim et al. ("A multi-slotted antenna for LTE/5G sub-6 GHz wireless communication applications," International Journal of Microwave and Wireless Technologies, September 2020, DOI: 10.1017/s1759078720001336, hereinafter "Azim II"). The small (20 mm×30 mmx 1.5 mm) proposed antenna operates in the 3.15-5.55 GHz band, but fails to cover WiMAX 5.8 GHz, in addition to WiFi 5.9 GHz.

Additionally, patented solutions fail to address all the above-mentioned and below-noted drawbacks. In CN101908668B, a broadband antenna includes a first radiating body, a second radiating body, a connecting part and a feed-in line. The apparatus achieved a −6 dB operating band ranging from 1400-2700 MHz and can cover some typical telecommunications standards (e.g., Global Positioning System (GPS) 1500 MHz, Digital Cellular System (DCS) 1800 MHz, Personal Communication Service (PCS) 1900 MHz, Universal Mobile Telecommunications System (UMTS) 2100 MHz, and/or WLAN 2400 MHz). However, this structure fails to cover a number of other bands, such as those used by WiMAX, WLAN, 4G and 5G standards. An LTE antenna in CN203674396U having an all-metal frame is described. The antenna in this disclosure also includes a feeding element and a radiating element, achieving a frequency range to meet the requirements of Global System for Mobile Communications (GSM) 850/900, DCS, PCS, UMTS, LTE, and Time-Division Synchronous Code-Division Multiple Access (TD-SCDMA) 1800/2000/2300 standards. Once again, the operating band fails to achieve frequencies suitable for WiMAX, WLAN, 4G, and 5G communication systems.

U.S. Pat. No. 10,374,287 B2 describes an antenna configured with a complete metal back plate for covering for a main section, two sidewalls opposite to each other, a circuit board having the main ground point, and a pair of antenna units electrically attached to the circuit board. Two gaps are formed between the sidewalls and the main body in order to help the disclosed system to operate over two frequency bands (1710-2170 MHz and 2500-2690 MHz). Similar to other solutions noted above, this design fails to cover WLAN, WiMAX, 4G LTE and 5G sub-6 GHz communication bands.

In CN203826551U, a dual-polarized Vivaldi antenna for ultra-wideband (UWB) communication applications is disclosed. The described antenna includes a dielectric plate, which is printed and metalized on both sides. A surface-mounted metal sheet is used as a radiator, and a microstrip line feeding structure is included. A comb-shaped grid is located along the side of the metal sheet to enable current to be concentrated and flow near a slotline. The operating band of this design is 3.1-10.6 GHz, while the voltage standing-wave ratio, VSWR, is less than 2.5. However, this solution also occupies a large three-dimensional volume of 40 mm×40 mm×72 mm.

The aforementioned systems suffer from one or more drawbacks hindering their adoption, such as having a complex structure and/or 3D profile. Many of the radiators in the above-mentioned antennas are vertical to the ground plane, resulting in large antenna sizes and making integration of microwave circuitries impossible. In addition, existing antennas cover only a fraction of the combined frequency ranges used by WLAN, WiMAX, WiFi, 4G, and 5G sub-6 GHz, which prevents a single antenna operating over the entire band to cover the above-mentioned standards and protocols. Moreover, most of these antennas produce a relatively large electric field and can become strongly coupled with nearby objects, resulting in degradation of signal quality. These conventional structures are also less desirable for portable computing devices because of suboptimal performance within various frequency ranges. Accordingly, an antenna structure is needed that operates across the entire range of 3.25-8.66 GHz, while employing a small integrable design suitable for portable and hand-held devices.

SUMMARY

In an exemplary embodiment, a planar antenna includes a radiator and a ground plane on opposite faces of a substrate. The radiator includes a printed microstrip that includes a human face-shaped radiator pattern printed on a first face of the substrate. The human face-shaped radiator pattern has an elliptical head portion, two eye portions with printed eyeball portions, two ear portions, and a mouth portion. The printed microstrip connects to the human face-shaped radiator pattern. The ground plane includes first second, and third circular defect areas. The first and second circular defect areas have the same diameter, while the third circular defect area has a diameter smaller than the first and second circular defect areas. The third circular defect area is closer to an end surface of the ground plane than the first and second circular defect areas.

In some embodiments, the first and second circular defect areas have a diameter of 3 mm and the third circular defect area has a diameter of 2 mm. In certain embodiments, the bottom points of each of the first and second circular defect areas are 4.68 mm from the end surface of the ground plane. In embodiments, the first and second circular defect areas overlap positions to the side of the printed microstrip substrate. In certain embodiments, the third circular defect area overlaps at a position under the printed microstrip feedline. In embodiments, the ground plane includes a rectangular defect area adjacent to the first circular defect area that extends parallel to a side-surface of the ground plane. In certain embodiments, the rectangular defect area has a length of 4.9 mm.

In some embodiments, the elliptical head portion of the radiator has a width of 10 mm and a diameter of 12 mm. In certain embodiments, the printed microstrip includes a widened collar portion at a junction of the printed microstrip feedline to the human face-shaped radiator pattern. In embodiments, the printed microstrip feedline has a thickness of 3 mm extending from the collar portion away from the human face-shaped radiator pattern.

In some embodiments, the substrate has a thickness of 1.4 mm with a dielectric constant of 4.6 and loss tangent of 0.02. In certain embodiments, an operating band range of the planar antenna ranges from 3.25 GHz to 8.66 GHz for a reference level greater than −10 dB.

The foregoing general description of the illustrative embodiments and the following detailed description thereof are merely exemplary aspects of the teachings of this disclosure, and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
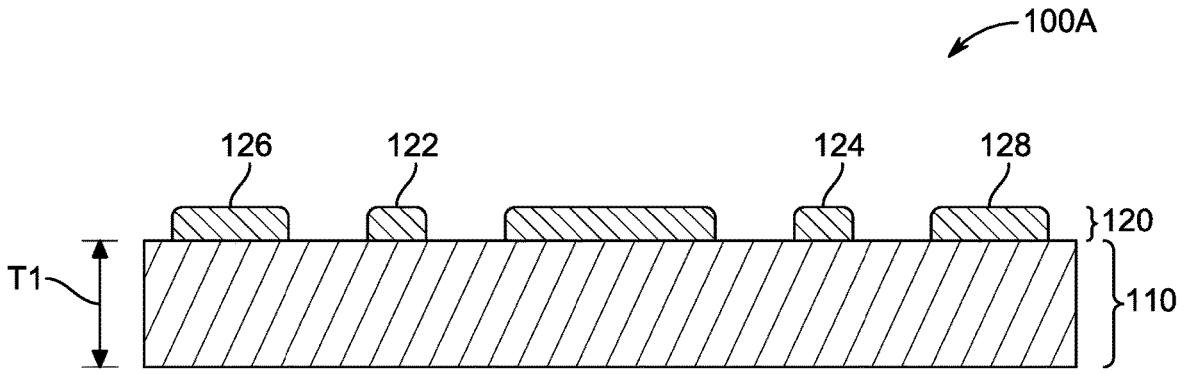
FIG. 1A and FIG. 1B are cross-sectional views of a planar antenna apparatus, according to certain embodiments.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms generally refer to ranges that include the identified value within a margin of 20%, 10%, or preferably 5%, and any values therebetween.

Compared to conventional three-dimensional (3D) antennas, the antenna of various embodiments described above and below is printed on a microwave substrate. Thus, a slimmer vertical profile is enabled by the disclosed embodiments. When compared to the dimensions of many previously developed antennas, the described antenna provides a smaller overall design footprint, appropriate for many hand-held and/or portable devices using a number of transmission protocols and standards.

According to embodiments of the present disclosure, a planar antenna with a human-face shaped patch configuration and a defected ground plane/plate can tune across frequencies ranging from 3.25 GHz to 8.66 GHz. By enabling such a tuning range, the planar antenna of the present application covers the licensed band for sub-6 GHz 5G communications, as well 4G LTE bands and well-established WiFi, WiMAX, WLAN, and UWB standards and/or protocols. This design and/or construction renders the disclosed antenna suitable for integration within various portable computing devices.

Etching and inserting parasitic elements in the ground plane/plate decreases the reflection coefficient and enlarges the effective bandwidth. The defected ground plane also provides a number of advantages—increasing gain while simultaneously reducing harmonics, mutual coupling, and the overall size of the antenna. Moreover, the antenna of this application performs well when near field coupling must be kept to a minimum, due to the relatively large magnetic fields the antenna possesses.

Figure 2:
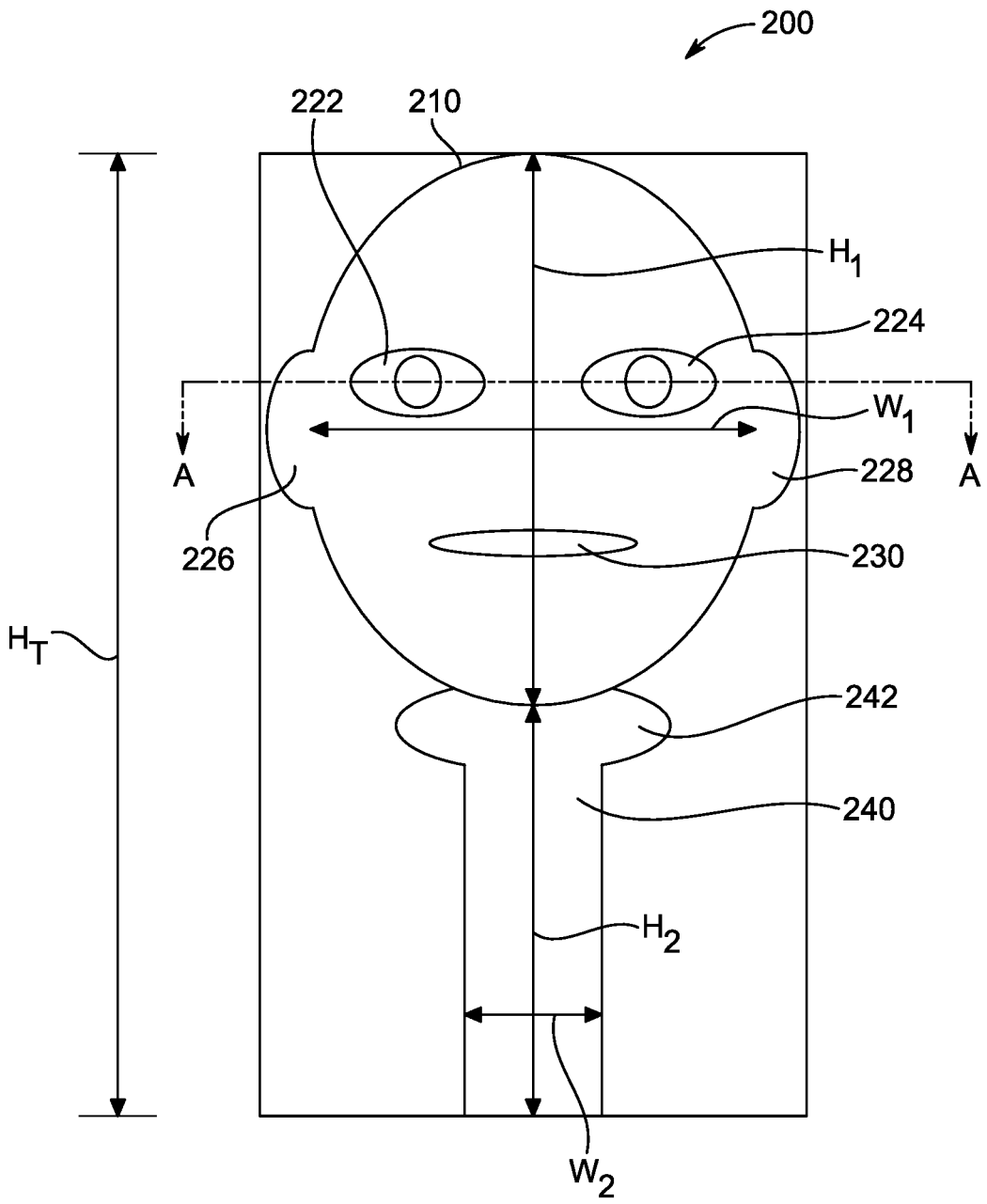
FIG. 2 is a radiating patch portion of the planar antenna apparatus, according to certain embodiments.

FIG. 1A is a cross-sectional view 100A of a planar antenna apparatus (taken along a cross-sectional line A as shown in FIG. 2), according to embodiments of the present application. As depicted, the planar antenna is printed on a first face of substrate 110, with a radiating patch printed as a layer 120. As shown in FIG. 1A, cross-sectional view 100A is one that would be seen across the center of a human face-shaped radiating patch of the antenna. There are openings for eyes with printed "pupils" shown as elements 122 and 124 of the radiating patch. Across this cross-section, there are also portions of the radiating patch for the head and ears numbered as elements 126 and 128. Shown but not numbered is an additional portion of the face-shaped radiator located in the center of layer 120. Layer 120 is made of or contains conductive metallic material, such as copper, in order to form the radiator.

Not shown in this view is an opening for a mouth, as well as a shaped portion of the radiating patch that includes a neck and collar structure. These portions are shaped across a different cross-section and are described in further detail below with respect to FIG. 1B. While certain shapes and relationships are shown in cross-sectional view 100A of FIG. 1A, one of skill in the relevant art will recognize that the figure may not be drawn to precise scale or in the same exact proportions as would result from real-world fabrication of the antenna structure.

According to some embodiments, substrate 110 is a 1.6 mm thick rectangle of a printed circuit board (PCB) substrate material, having a width of 12 mm and a length of 22.2 mm. The 1.6 mm thickness of substrate 110 is denoted as T1 in FIG. 1A. According to certain embodiments, substrate 110 has a dielectric constant of 4.6 and loss tangent of 0.02.

As an example, substrate 110 can be an epoxy laminate material, such as an FR-4 glass-reinforced epoxy laminate with good fire-retardant and electrical insulating properties. In some embodiments, the dielectric constant may be slightly more or less than 4.6, while the loss tangent parameter may have a value slightly more or less than 0.02. Measurements for the dimensions of substrate 110 may also deviate slightly in accordance with fabrication tolerances. Different types of epoxies, laminates, and/or reinforcing materials may also be considered, such as a phenol-based substrate material. Other substrate materials with suitable electrical, physical and manufacturing properties (i.e., high mechanical strength, durable, electrically insulating, hydrophobic, and low production cost) may be substituted without departing from the scope of the present application.

Figure 1B:
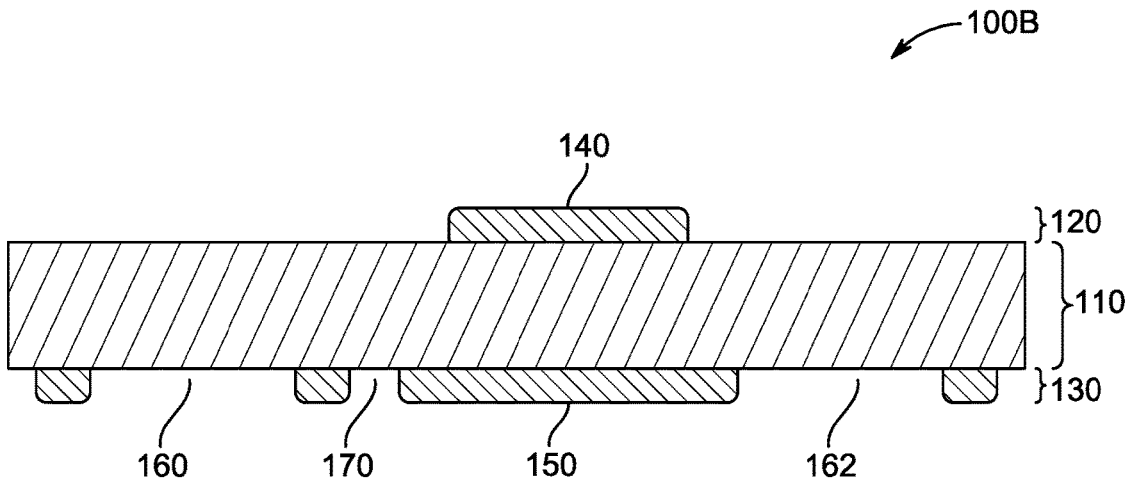
Figure 3:
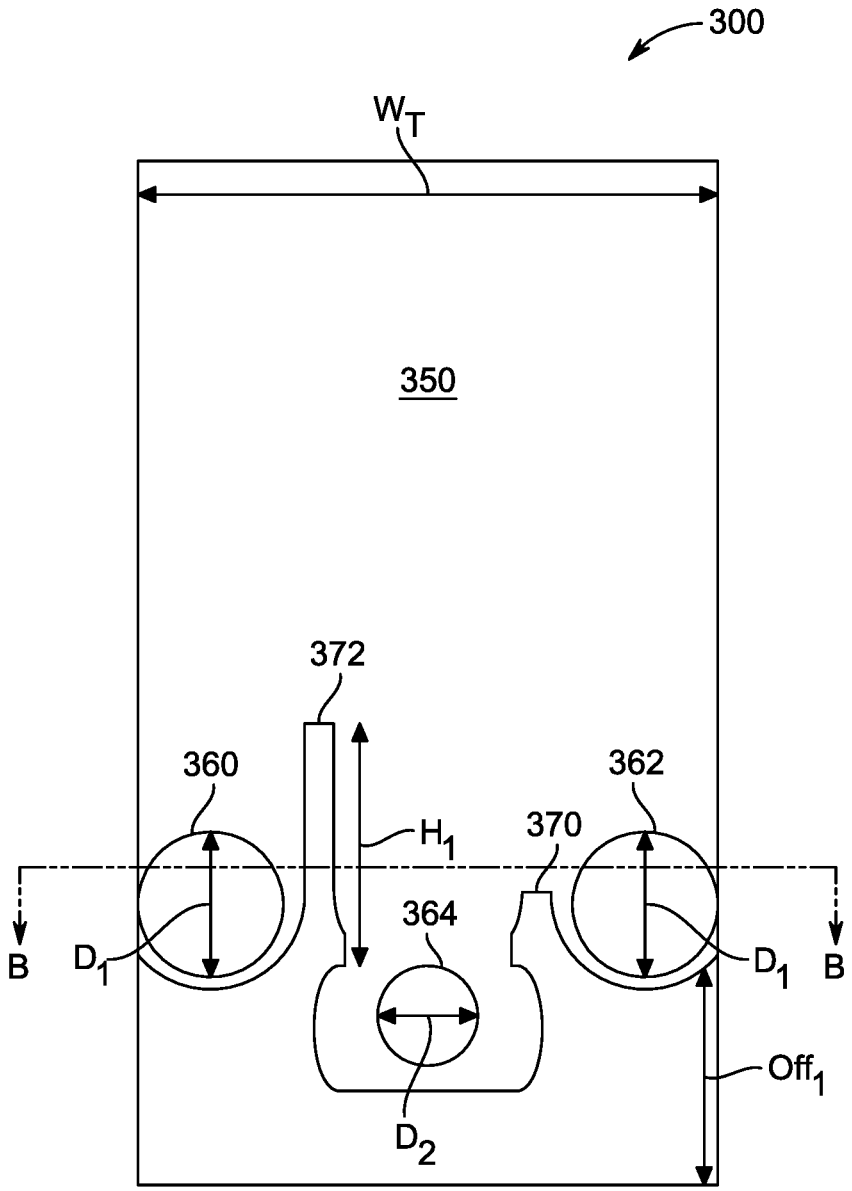
FIG. 3 is a ground plane portion of the planar antenna apparatus, according to certain embodiments.

FIG. 1B depicts a second cross-sectional view 100B of the planar antenna (taken along a cross-sectional line B as shown in FIG. 3), including both portions of the radiating patch and portions of the ground plane/plate. Substrate 110 and layer 120 are again shown, along with layer 130 for the printed ground plate. Substrate 110 is again a thickness T1 as shown and described in FIG. 1A above. A radiating patch 140 printed in layer 120 at this cross-section is much smaller and a single strip, when compared to the portions of the radiating patch described in FIG. 1A. This portion is part of a neck and collar feature of the overall radiating patch as to be described in further detail below with respect to FIG. 2. In some embodiments, the width of the element 140 is 3 mm and this portion functions as a feed line for the antenna realized by the "facial" portion of the radiating patch.

Layer 130 as shown in FIG. 1B is a cross-section of a ground plane or ground plate feature (either term may be used interchangeably in this disclosure) on the bottom of substrate 110. The ground plate printed at layer 130 may be a copper fill, or other suitable conducting material, such as another conducting metal or alloy, for electrically grounding the antenna. A primary ground plane/plate portion 150 is surrounded by a first ring 160 and a second ring 162, as well as a rectangular channel 170. These features will be described in greater detail below with respect to FIG. 3, but the channels denoted by elements 160 and 162 form rings of approximately equal diameter. In some embodiments, first and second rings 160 and 162 have a diameter of 3 mm.

Rectangular channel 170 is part of a rectangular feature etched from the ground plate 150, having a larger length than width. In some embodiments rectangular channel 170 has a length of 4.9 mm, with a width significantly less than 4.9 mm. As depicted in cross-sectional view 100B, the smaller dimension is visible as the width of channel 170, while the larger dimension is understood to be measured as if into or out of the figure (i.e., towards/away from the page).

The channels and defects etched from the copper may be formed by laser etching or any other suitable method of removing copper otherwise covering the bottom of substrate 110. As alternatives, one of various mechanical evacuation methods or general lithography methods can be employed in removing a conducting material from substrate 110. In certain embodiments, first ring 160 and second ring 162 may be filled with a dielectric material. As an example, the same or a similar material as substrate 110 may be used to fill the channels shown at first and second rings 160/162. In other instances, a different material from substrate 110, but one with good insulating properties, can be inserted in channels 160 and 162. The same or a different method of creating defects at rectangular channel 170, and for a third ring not show in FIG. 1B, can be employed.

In some embodiments, a conducting foil/coating may be added to the bottom of substrate 110 rather than portions of a full ground plate removed. In some instances, a conducting copper foil with an adhesive for attaching layer 130 to substrate 110 can be used (e.g., copper foil tape). In alternative embodiments, other methods of attaching a conducting foil to substrate 110 may be employed, such as by a 3D printing method, by an electrical or chemical plating process, or by one or more other suitable fabrication methods.

Top and bottom views of the planar antenna described in the cross-sectional views 100A and 100B are now depicted in further detail in FIG. 2 and FIG. 3, respectively. FIG. 2 shows a top view of a radiating patch 200, which is a portion of the planar antenna apparatus, according to certain embodiments. Radiating patch 200 includes human face-shaped radiator 210, which is an elliptical-shaped patch with anthropomorphic features embedded therein. Face-shaped radiator 210 has a height, denoted as H1, and a width W1. In certain embodiments, radiator 210 is 12 mm×10 mm, that is to say that H1 is 12 mm and W1 is 10 mm. The human face-shaped patch includes the moderately realistic features of eyes 222/224 (complete with iris/pupils), ears 226/228, and a mouth 230.

In addition to the face-shaped radiator 210, a neck 240 and a collar 242 are shown. Neck 240 is a line feeding the radiating portion of the overall planar antenna structure having a height and a width denoted as H2 and W2, respectively. In some embodiments, neck 240 is a 3 mm wide by 10.2 mm long strip. A total height, denoted by $H_T$ in FIG. 2, gives the entire height of the radiating portion of the planar antenna. In certain embodiments, the total height is 22.2 mm. $_{[R1]}$]Minor deviations in those dimensions may be made without departing from the scope of the present application.

According to some embodiments, neck 240 is configured to provide a specified impedance for use as an appropriate feed line to the radiator 210 of radiating patch 200. According to some embodiments, neck 240 is configured to provide a 50-Ω impedance. The required operating band, across the vast number of telecommunications standards discussed above, is achieved through the proper coupling between the radiating patch 200/radiator 210 and a ground plane described in further detail above and below. Neck 240 can be configured to properly match for other impedance values as appropriate.

Radiating patch 200 and the various subcomponents thereof can be formed of any suitable conductive material. For example, in some embodiments radiating patch can be formed of copper. Other metals with the proper conductive properties can be used (e.g., aluminum, silver, gold, platinum, tin, other conductive metals, or alloys thereof) according to alternative embodiments.

When compared to the previously mentioned conventional antennas, a size reduction can be attained through the use of a defected partial ground plane according to embodiments of the present disclosure. For example, FIG. 3 depicts a bottom view of a ground plane 300, which is a portion of the planar antenna apparatus according to certain embodiments. Ground plane 300 includes a ground plate 350, which occupies the majority of the bottom surface of substrate 110. To reduce both ground plane dependency as well as cross-polarization, defects have been added to ground plate 350 by inserting three circular parasitic defect areas 360, 362 and 364 (also referred to as "parasitic rings" in this description). Additionally, a slot 370 and a vertical rectangular channel 372 are etched in ground plane 350.

If ground plate 350 were to occupy all of ground plane 300 (i.e., a full ground plane), a patch antenna would provide a very narrow bandwidth. Alternatively, a theoretical patch antenna with a small partial ground plane would exhibit a small operating band. The etching of slot 370 and insertion of parasitic elements 360, 362, 364 and 372 as shown in FIG. 3, on the other hand, decreases the reflection coefficient and enlarges the bandwidth significantly. Defected ground plate 350 also helps to increase the gain, while reducing harmonics, mutual coupling, and the size of the antenna itself. As mentioned above, the parasitic elements can be evacuated portions of ground plate 350. However, one or all of these elements can also include occupying the identified areas with a substrate material, such as substrate 110, or some other electrically insulating filler.

By configuring the dimensions of parasitic elements 360/362/364/372 and slot 370 in the above and below described manner, favorable impedance matching can be achieved over the entire 3.25-8.66 GHz frequency range. First and second rings 360/362 have a first diameter, which are denoted as $D_1$, while third ring 364 has a second diameter, denoted $D_2$. Based on the disclosed embodiments, the antenna is in turn a suitable candidate for various short-distance wireless communication protocols (e.g., WiFi, WiMAX, WLAN, UWB, 4G LTE, and 5G-sub-6 GHz band applications). In some embodiments, third circular defect area 364 has a diameter of 2 mm, while first circular defect area 360 and second circular defect area 362 each have a diameter of 3 mm as mentioned previously.

With regard to positioning of the defects in ground plate 350, in some embodiments the first and second circular defect areas 360/362 overlap positions to the side of printed microstrip 240. The bottom points of each of the first and second circular defect areas, denoted as OM in FIG. 3 (to denote an offset distance), can be equally distant from the bottom corner of ground plane 300. In certain embodiments, first and second circular defect areas 360/362 are 4.68 mm from the end surfaces (i.e., the "bottom corners") of ground plane 300. In various embodiments, the third circular defect area 364 overlaps at a position under the printed microstrip (i.e., neck 240 as shown in FIG. 2).

In some embodiments, ground plane 300/ground plate 350 includes rectangular defect area 372 adjacent to first circular defect area 360 that extends parallel to a side-surface of ground plane 300. Rectangular defect area has a height denoted as $H_1$, which is a significantly larger than its width. In certain embodiments, rectangular defect area 372 has a height of 4.9 mm as previously noted, although other heights may be used if ground plate 350 is configured differently as understood by one of skill in the relevant arts.

While the above specific configuration of defects and parasitic elements have been described with relation to ground plane 300, other specific combinations of these features can be employed without departing from the scope of the present application. Alterations for specific frequency responses will be understood. Minor deviations due to fabrication and/or tolerances are also contemplated as a part of the present disclosure.

Not depicted in the above figures are the specific methods of connecting radiating patch 200/radiator 210 to ground plane/plate 350. One of skill in the relevant arts of antenna design and printed circuit construction will appreciate that radiator 210 will be electrically in communication with ground plate 350, despite the insulating material of substrate 110 separating the two. Thus, various methods of connecting radiator 210 and ground plate 350 can be used in conjunction with the present embodiments. As one example, neck 240 could extend "around" the edge of substrate 110 to the portion of ground plate 350 nearest that feature. In other embodiments, the upper and lower portions can be electrically connected directly above and below radiating patch 200 and ground plane 300 to send connections through the FR-4 substrate. Other wires, connections, or means of putting radiating patch 200 and ground plane 300 in electrical communication with one another would be apparent to one of skill in the relevant arts.

Figure 4:
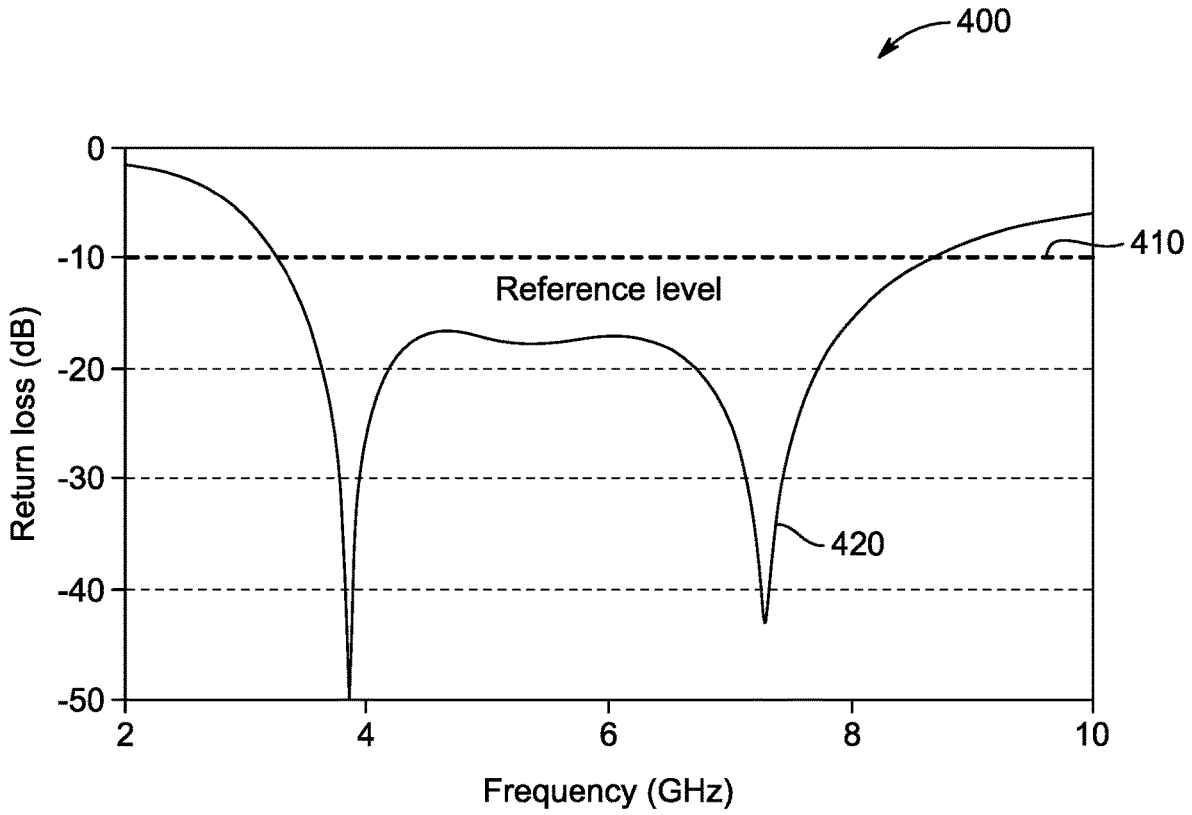
FIG. 4 is a graph representing return loss as a function of operating frequency of the planar antenna apparatus, according to certain embodiments.

Turning now to FIG. 4, a graph 400 representing return loss as a function of operating frequency of the planar antenna apparatus is depicted, according to certain embodiments. A reference level 410 is shown at the return loss value of −10 dB. As seen by curve 420 in FIG. 4, the antenna described above and below performs suitably across an operating band ranging from 3.25 GHz to 8.66 GHz. As such, the described planar antenna structure transmits and receives across the WiFi, WiMAX, WLAN, UWB, 4G, and 5G sub-6 GHz wireless bands.

According to the disclosed embodiments, the planar antenna of the instant application has a compact planar profile, employs a simple design as well as a relatively small size, and is inexpensive when constructed with inexpensive substrate materials. The antenna of the above-described embodiments attained an operating band of 5.41 GHz (3.25-8.66 GHz), satisfactory gain for transmitting and receiving signals, good operational efficiency and can effectively be used in a wide range of wireless services including WiFi, WiMAX, WLAN, UWB, 4G, and 5G sub-6 GHz applications.

The above-described hardware description is a non-limiting example of corresponding structure for performing the functionality described herein. Obviously, numerous modifications and variations of the present disclosure are possible in light of the above teachings. It is therefore to be understood that within the scope of the appended claims, the invention may be practiced otherwise than as specifically described herein.

The invention claimed is:

1. A planar antenna comprising:

a substrate;

a radiator formed on a first face of the substrate; and a ground plane formed on a second face of the substrate opposite to the first face of the substrate;

the radiator comprising:

a human face-shaped radiator pattern printed on the first face of the substrate and comprising:

(1) an elliptical head portion;

(2) two eye portions with printed eyeball portions;

(3) two ear portions; and (4) a mouth portion; and a printed microstrip line to connect to the human face-shaped radiator pattern; and the ground plane including:

a first circular defect area;

a second circular defect area; and a third circular defect area;

wherein the first and second circular defect areas have a same diameter and the third circular defect area has a smaller diameter than the first and second circular defect area, and the third circular defect area is closer to an end surface of the ground plane than the first and second circular defect areas.

2. The planar antenna according to claim 1, the ground plane further including a rectangular defect area adjacent to the first circular defect area and that extends parallel to a side-surface of the ground plane.

3. The planar antenna according to claim 2, wherein the first and second circular defect areas have a diameter of 3 mm and the third circular defect area has a diameter of 2 mm.

4. The planar antenna according to claim 3, wherein the rectangular defect area has a length of 4.9 mm.

5. The planar antenna according to claim 4, wherein bottom points of each of the first and second circular defect areas are 4.68 mm from the end surface of the ground plane.

6. The planar antenna according to claim 1, wherein the elliptical head portion of the radiator has a width of 10 mm and a diameter of 12 mm.

7. The planar antenna according to claim 6, wherein the printed microstrip line includes a widened collar portion at a junction of the printed microstrip to the human face-shaped radiator pattern.

8. The planar antenna according to claim 7, wherein the printed microstrip line has a thickness of 3 mm extending from the collar portion away from the human face-shaped radiator pattern.

9. The planar antenna according to claim 1, wherein the substrate has a thickness of 1.4 mm with a dielectric constant of 4.6 and loss tangent of 0.02.

10. The planar antenna according to claim 1, wherein for a reference level greater than −10 dB an operating band range of the planar antenna ranges from 3.25 GHz to 8.66 GHz.

11. The planar antenna according to claim 6, the ground plane further including a rectangular defect area adjacent to the first circular defect area and that extends parallel to a side-surface of the ground plane.

12. The planar antenna according to claim 11, wherein the first and second circular defect areas have a diameter of 3 mm and the third circular defect area has a diameter of 2 mm.

13. The planar antenna according to claim 12, wherein the rectangular defect area has a length of 4.9 mm.

14. The planar antenna according to claim 13, wherein bottom points of each of the first and second circular defect areas are 4.68 mm from the end surface of the ground plane.

15. The planar antenna according to claim 14, wherein the first and second circular defect areas overlap positions to the side of the printed microstrip line.

16. The planar antenna according to claim 15, wherein the third circular defect area overlaps at a position under the printed microstrip line.

17. The planar antenna according to claim 16, wherein the printed microstrip includes a widened collar portion at a junction of the printed microstrip line to the human face-shaped radiator pattern.

18. The planar antenna according to claim 17, wherein the printed microstrip line has a thickness of 3 mm extending from the collar portion away from the human face-shaped radiator pattern.

19. The planar antenna according to claim 18, wherein the substrate has a thickness of 1.4 mm with a dielectric constant of 4.6 and loss tangent of 0.02.

20. The planar antenna according to claim 19, wherein for a reference level greater than −10 dB an operating band range of the planar antenna ranges from 3.25 GHz to 8.66 GHz.

* * * * *